United States Patent [19]

Randall

[11] Patent Number: 4,530,189

[45] Date of Patent: Jul. 23, 1985

[54] DOOR ENTRANCE

[75] Inventor: Charles E. Randall, Monroe Township, Monroe County, Pa.

[73] Assignee: Westinghouse Electric Corp., Pittsburgh, Pa.

[21] Appl. No.: 488,308

[22] Filed: Apr. 25, 1983

[51] Int. Cl.[3] ..... B66B 9/00

[52] U.S. Cl. ..... 52/30; 52/212; 52/215; 49/504; 109/77; 187/1 R

[58] Field of Search ..... 52/211, 215, 217, 212, 52/213, 204, 731, 30; 187/1 R; 109/77; 49/504, 472, 505, 401

[56] References Cited

U.S. PATENT DOCUMENTS

| | | | |
|---|---|---|---|
| 1,817,346 | 8/1931 | Campbell | 49/472 X |
| 3,535,837 | 10/1970 | Atkinson et al. | 52/30 |
| 4,226,066 | 10/1980 | Persson | 52/211 |

FOREIGN PATENT DOCUMENTS

| | | | |
|---|---|---|---|
| 214424 | 8/1957 | Australia | 187/1 R |
| 2411903 | 9/1975 | Fed. Rep. of Germany | 52/204 |
| 8300181 | 1/1983 | Int'l. Pat. Institute | 52/204 |
| 620750 | 5/1961 | Italy | 52/211 |

*Primary Examiner*—Donald G. Kelly
*Assistant Examiner*—Naoko N. Slack
*Attorney, Agent, or Firm*—Donald R. Lackley

[57] ABSTRACT

A fire resistant, elevator hatchway door entrance for wall openings up to and including 10 feet in height, including first and second side jambs and a head jamb. Each side jamb includes a pair of upstanding, oppositely facing, metallic channel members dimensioned and coupled together to define both a structural box beam and a pocket for receiving the wall which defines the opening. The bight and one leg portion of one channel member define the jamb depth and reveal, respectively, of the side jamb, and the bight of the other channel member receives and shields an asociated J-strut at the wall-entrance interface. The remaining leg portion of the one channel member may cooperate with a member disposed on the trailing edge of the associated door panel to define a flame shield and a mechanical limit for preventing undue separation of the door panel from the side jamb.

6 Claims, 4 Drawing Figures

DOOR ENTRANCE

BACKGROUND OF THE INVENTION

1. Field of the Invention

The invention relates in general to door entrances, and more specifically to fire resistant elevator hatchway door entrances.

2. Description of the Prior Art

The walls of a building may be constructed with a certain fire rating, and accordingly, the doors which close openings between the various compartments of the building should be constructed to maintain the integrity of the fire resistive walls. A standard method of fire testing door assemblies, which is set forth under the ASTM designation E152, mounts the doors in a wall enclosing a furnace, with the temperature of the exposed door assembly increasing with time according to a predetermined time-temperature curve. For example, if a 1½ hour rating is desired, the temperature will be at 1800° F. at the end of the 1½ hour exposure period. At the end of the exposure period, the door is rapidly cooled with water from a hose stream, the parameters of which are specified according to the fire rating desired and the square feet of exposed door area. One of the conditions for acceptance of horizontal slide-type elevator doors, is that the lap edges of the door panels shall not move from the wall or adjacent panel surfaces sufficiently to develop a separation of more than 2⅞ inches (73.0 mm) during the entire classification period, or immediately following the hose stream test.

The side jambs of elevator door and entrance assemblies tend to bow inwardly during such fire and hose tests, with the tendency being exacerbated with increasing door heights.

Dry wall construction, while relatively new in buildings, has rapidly replaced masonry construction. Thus, the fire rated door assemblies should be constructed to obtain the desired rating with dry wall construction. If a door assembly passes the fire test and obtains a fire rating with dry wall construction, it will also be suitable for masonry construction. The reverse may not be true, as masonry construction provides more support for the entrances than dry wall.

While a fire rating is desired for elevator door assemblies, it is essential that the rating be achieved with an economically competitive structure. Thus, it would be desirable to provide a new and improved fire resistant elevator door entrance assembly which is capable of being fire rated using dry wall construction, which is suitable for door heights up to and including 10 feet, and which may be economically manufactured and assembled.

SUMMARY OF THE INVENTION

Briefly, the present invention is a new and improved fire rated hatchway or hoistway door entrance assembly for elevators, which has passed the ASTM E152-80 tests for a 1½ hour rating in dry wall construction, for openings up to and including 10 feet. The side jambs, which provide the successful jamb-J-strut interface to the surrounding dry wall, each include first and second elongated, upstanding, oppositely facing, channel members formed of 0.090 inch thick steel. These channel members are dimensioned and coupled to define both a box beam structural member and a recess or pocket for receiving the outer or finish wall of the wallboard construction. The box beam structural member provides the requisite rigidity and thermal shield for the contractor-supplied J-strut, which is conventionally disposed to interface the adjacent edges of the dry wall construction and the elevator entranceway. The J-strut is rigidly fixed to the bight of the first channel member, and the bight of the second channel member defines the jamb depth. One of the leg portions of the second channel member functions as the reveal of the side jamb, and it also includes a flange which functions as the wall return. The remaining leg, in addition to cooperating in the development of the box beam structural assembly, also cooperates with a U-shaped member on the trailing edge of the associated door panel, to provide a flame shield.

The box beam assembly thermally shields the J-strut, and it conducts heat up its chimney-like opening to enable the J-strut to remain attached to the inner dry wall structure, and the recess or pocket which receives the outer dry wall overlaps the inner dry wall structure and J-strut, to provide still additional structural rigidity and thermal shielding.

BRIEF DESCRIPTION OF THE DRAWING

The invention may be better understood, and further advantages and used thereof more readily apparent, when considered in view of the following detailed description of exemplary embodiments, taken with the accompanying drawings in which.

DESCRIPTION OF THE PREFERRED EMBODIMENTS

Figure 1:
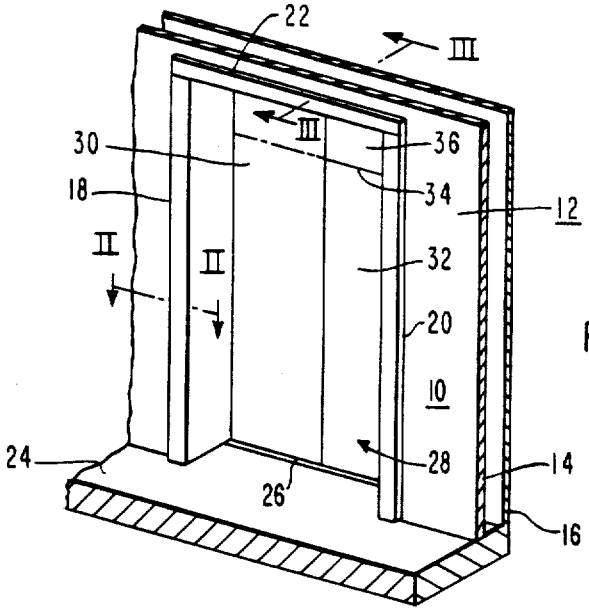
FIG. 1 is a perspective view of an elevator hatchway door entrance which may be constructed according to the teachings of the invention.

Referring now to the drawings, and to FIG. 1 in particular, there is shown the hallway side of an elevator hatchway or hoistway door entrance 10 which may be constructed according to the teachings of the invention. Entrance 10 provides access to an elevator car through an opening in hallway wall 12, which for purposes of example is illustrated as dry wall construction. The dry wall construction, at least adjacent to the entrance, includes an outer or finished wall portion 14 and an inner or unfinished wall portion 16. Entrance 10 includes first and second upstanding side jambs 18 and 20, respectively, and head jamb 22. The lower ends of the side jambs 18 and 20 are secured to the floor 24 of the hallway, adjacent to the door sill 26, such as by bolts. The head jamb 22 is secured to the upper ends of the side jambs 18 and 20, such as by bolts, by welding the butt joints shown in FIG. 1, or by mitering and welding the adjoining ends, as desired.

A hoistway door 28 is mounted for horizontal slidable movement on the hoistway side of the entrance 10. Door 28 may include one or more panels, and may be single speed side opening (SSSO), single speed center opening (SSCO), two speed side opening (2SSO), or two speed center opening (2SCO), as desired. Door 28 is illustrated as SSCO, and it thus has first and second door panels 30 and 32, respectively. The door panels are constructed of a ribbed-steel structure to provide the desired fire rating. Since such door panel construction is conventional and well known in the art, the door panel construction per se will not be described.

Figure 4:
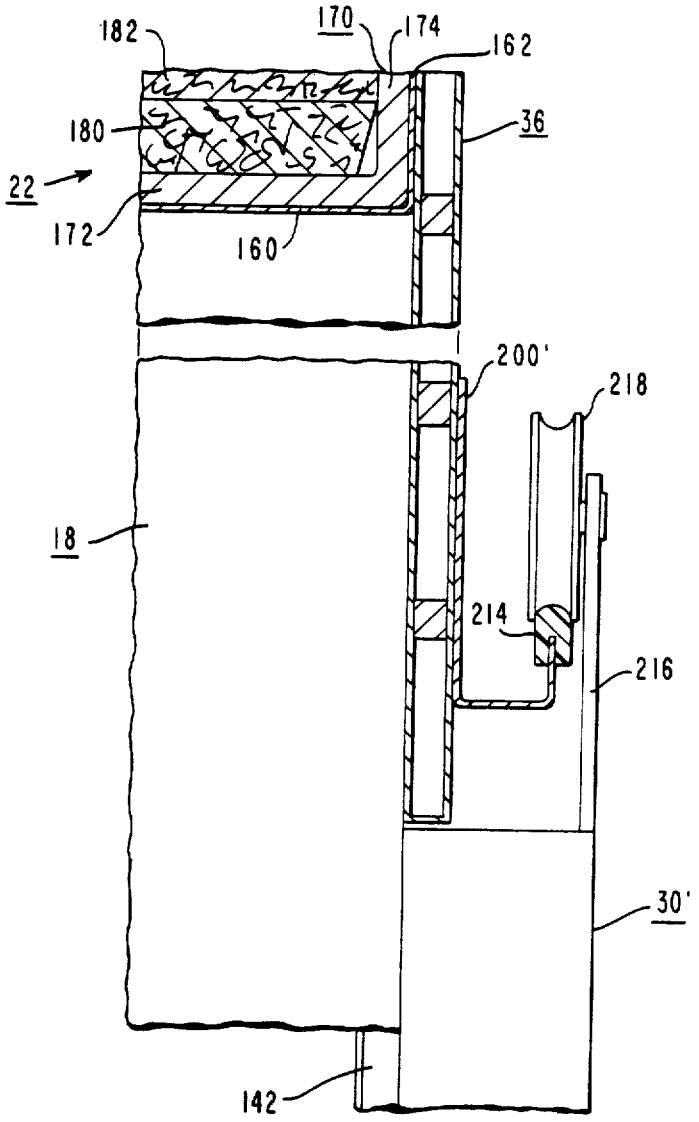
FIG. 4 is a cross-sectional view of the head jamb of the entrance shown in FIG. 1, with a transom, taken between and in the direction of arrows III—III.

The door panels 30 and 32 may extend to the head jamb 22, or a transom may be disposed from the top of the door panels to the header 22. The broken line 34 indicates that a transom 36 may be disposed above the door panels 30 and 32. The transom 36, if used, may be an offset pan transom backed with a fire test wall, an offset fire test transom constructed the same as the fire test door panels, or a flush transom may be used, as desired. The transom embodiment shown in FIG. 4 illustrates a flush transom, which requires a thicker door panel than the offset transoms.

Figure 2:
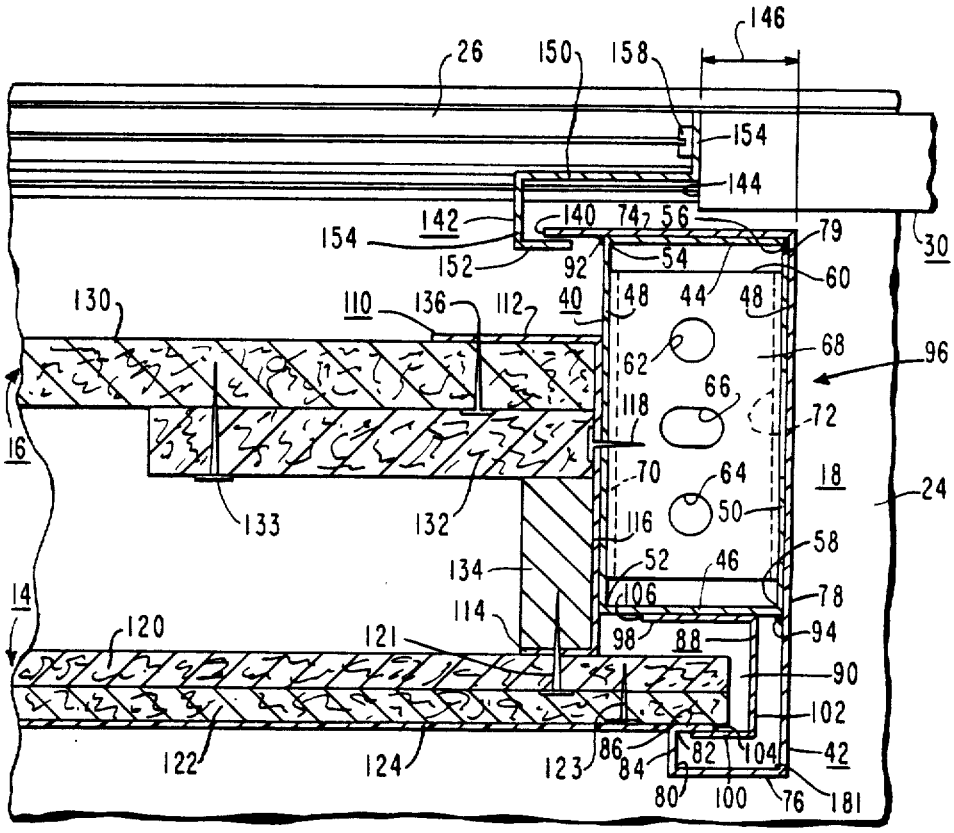
FIG. 2 is a cross-sectional view of the side jamb of the entrance shown in FIG. 1, taken between and in the direction of arrows II—II.

FIG. 2 is a cross-sectional view of the first side jamb 18, taken between and in the direction of arrows II—II of FIG. 1. Side jamb 18, which is constructed according to the teachings of the invention, includes first and second elongated, upstanding, oppositely facing, metallic channel members 40 and 42, respectively, which may be constructed of 0.090 inch thick steel. The first channel member includes first and second parallel leg portions 44 and 46, respectively, which are integral with a bight portion 48. The outwardly extending ends of leg portions 44 and 46 are bent towards one another, in a common plane, to define flanges 48 and 50. Thus, the first channel member 40 has a substantially rectangular cross-sectional configuration, having first, second, third, and fourth right angle bends 52, 54, 56 and 58, respectively, which provide a very strong and rigid structure. A plurality of ribs or jamb brackets 60 may be welded within the rectangular opening defined by the first channel member 40, at each longitudinal end thereof, and also at predetermined spaced intervals along the longitudinal axis of the channel member. At least the brackets 60 disposed at the ends of the channel member 40 may have openings 62 and 64 for receiving bolts, if the ends are to be bolted to the floor 24 and to the head jamb 22. Additional openings, such as openings 66, may be provided to enable the channel member 40 to allow heated air to rise and thus lower the temperature of the side jambs in a fire situation. Brackets 60, for example, may include a major flat bight portion 68, through which the openings extend, and first and second leg portions 70 and 72 which extend snugly along two opposite internal sides of the rectangular opening defined by channel member 40.

The second channel member 42 includes first and second parallel leg portions 74 and 76, respectively, which are integral with a bight portion 78, joining bight portion 78 with right angle bends 79 and 81. The bight portion 78 defines the jamb depth, and is dimensioned accordingly. The outwardly extending end of the second leg portion of the second channel member 42 is bent twice at right angle bends 80 and 82 to create flanges 84 and 86, respectively. The portion of the second leg 76 which extends between bends 80 and 81 is the reveal, and is dimensioned accordingly, the flange 84 between the bends 80 and 82 functions as the wall return, and flange 86, which contacts the outer wall 14, provides additional strength as well as a surface for receiving a plurality of additional strengthening ribs or jamb brackets 88.

The width dimension of bight 48 of the first channel member 40 is selected to be less than the width dimension of the bight 78 of the second channel member 42, such that when the first and second channel members 40 and 42 are oppositely oriented, i.e., placed with their bight portions parallel and their leg portions facing one another, they may be assembled with leg portions 44 and 74 in contact with one another, and with the right angle bends 56 and 79 nested. This assembly creates a predetermined pocket or recess 90 between the leg portions 46 and 76. This assembled position of the first and second channel members 40 and 42 is maintained by welding, such as indicated at 92 and 94, to cooperatively create a high strength rigid box beam assembly 96, in addition to cooperatively creating the pocket or recess 90.

The elements of the first and second channel members 40 and 42 which define the recess 90 are strengthened by the jamb brackets 88. The jamb brackets are U or J-shaped, having first and second leg portions 98 and 100 integral with and extending perpendicularly outward from a bight portion 102. The bight portion 102 is adjacent to and parallel with bight portion 78 of the second channel member 42, and its leg portions 98 and 100 extend in the same direction as leg portions 74 and 76 of the second channel member 42. Leg portion 100 is welded to flange 86, such as indicated at 104, and leg portion 98 is welded to leg portion 46, such as indicated at 106. Thus, the opening between leg portions 98 and 100 of bracket 88 preserves the "pocket" effect originally created by the spaced leg portions 46 and 76, while adding rigidity and strength to the pocket forming elements of the first and second channel members 40 and 42, respectively.

Dry wall installations utilize a steel channel member 110 called a J-strut, supplied by the dry wall contractor, to protect the dry wall at the interface between the dry wall and entrance. This interface is critical and must be properly thermally shielded if the entranceway is to obtain a fire rating. The J-strut 110 includes spaced parallel first and second leg portions 112 and 114 which are integral with and extend perpendicularly outward from a bight portion 116. After the side jambs 18 and 20 are assembled in the opening, along with the head jamb 22, the bight portion 116 of the J-strut 110 is power nailed to the bight portion 48 of the first channel member 40, and thus to the box beam structure 96, such as indicated at 118.

The dry wall is constructed about the entranceway from the hallway side. The inner wall 16 is first constructed about the entranceway, such as by power nailing a one-inch wallboard 130 to leg 112 of the J-strut 110, as indicated at 136. A one-inch wallboard liner 132, which extends for the full entrance height, is disposed against wall 130 and against bight 116 of the J-strut. Liner 132 is power nailed to the inner wall 130, as indicated at 133. A wallboard shim 134 is pressed into the space between liner 132 and leg portion 114 of the J-strut. Shim 134 is sized to snugly hold wallboard 130 and liner 132 in the space between the leg portions 112 and 114 of the J-strut 110.

The outer or finish wall 14, which may include first and second half-inch wallboard panels 120 and 122, respectively, extends well into pocket 90, overlapping the plane of the bight 48 of the first channel member 40. The first wallboard 120 is power nailed to leg portion 114 of the J-strut 110, as indicated at 121. The second wallboard 122 is then placed in the pocket 90, tightly against the first panel 120 and flange 86, and power nailed to panel 120, as indicated at 123. Thus, the edges of the outer wall 14 which terminate at the side jambs 18 and 20, are sandwiched tightly between leg portion 114 and flange 86. A decorative finish 124, which is applied to the hall side of wall 14, extends at least up to the wall return 84.

The extreme end 140 of the first leg portion 74 of the second channel 42 extends outwardly past bight 48 of the first channel member 40, to cooperate with a U or J-shaped member 142 which is attached to the trailing edge 144 of the adjacent door panel 30. When door panel 30 is in its entrance closing position, its trailing edge overlaps the box beam structure 96 by a predetermined dimension, indicated at 146, as does the transom 36, if used. This is important in maintaining the integrity of the entranceway during the flame and hose spray tests. Member 142 and leg portion 74 cooperatively provide a flame shield, and they additionally provide a mechanical limit for holding the door panel 30 to the associated side jamb 18 during the flame and spray tests. The U or J-shaped member 142 includes first and second leg portions 150 and 152, and an integral connecting bight portion 154. Leg portion 150 may have an integral flange 156 at its extreme end for placement against the trailing edge 144 of the door panel 30, with flange 156 being fastened to the door, such as by a plurality of screws, indicated at 158. The spacing between leg portions 150 and 152 forms a pocket for receiving end 140 of the first leg portion 74 when the door panel 30 is in its closed position.

While the profile of the side jambs is illustrated as being square, the invention applies to other configurations, such as bullnose, round, or splayed.

Figure 3:
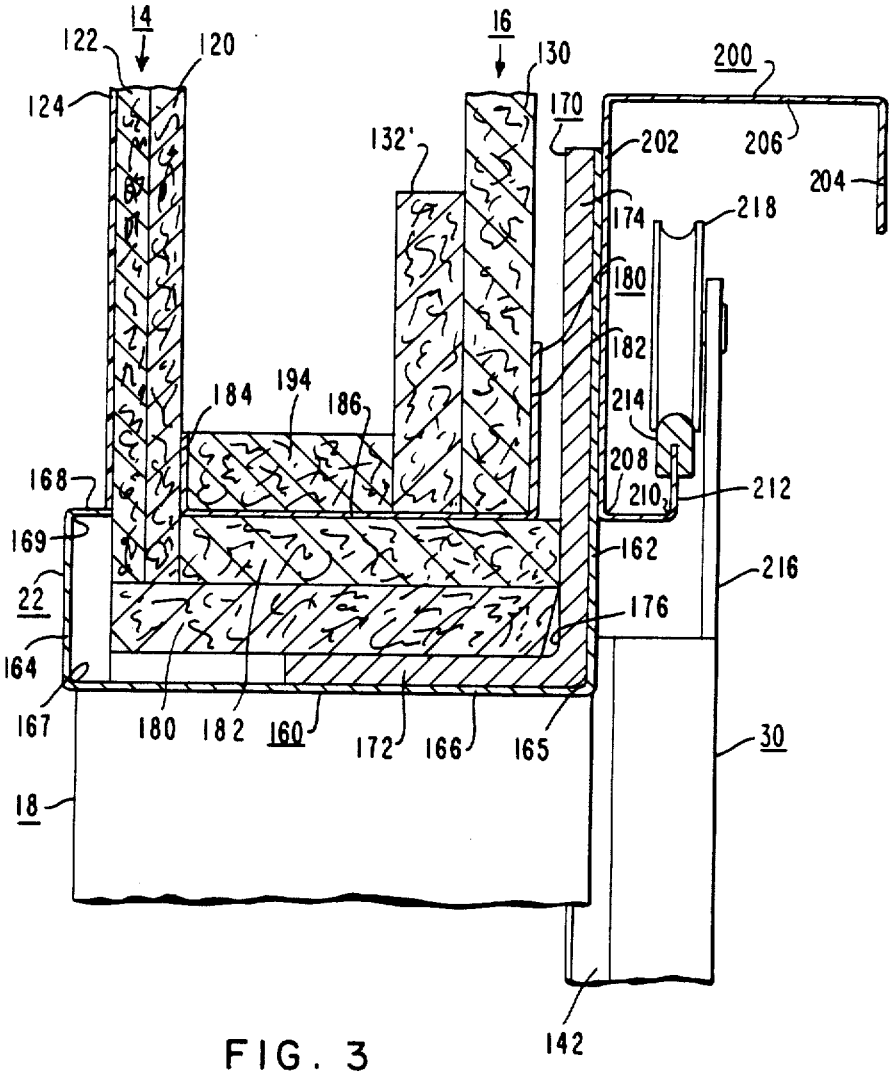
FIG. 3 is a cross-sectional view of the head jamb of the entrance shown in FIG. 1, without a transom, taken between and in the direction of arrows III—III.

FIG. 3 is a cross-sectional view of the head jamb 22, taken between and in the direction of arrows III—III of FIG. 1, illustrating an embodiment of the invention wherein the door panels extend to the head jamb 22. The head jamb 22 includes a steel channel member 160, having first and second leg portions 162 and 164 and an integral connecting bight portion 166. The leg portions 162 and 164 join the bight portion at right angle bends 165 and 167, respectively. The bight portion 166 defines the jamb depth, and is dimensioned accordingly. The extreme end of leg portion 164 is bent at 169 to form a right angle flange 168, which defines the wall return. The surface of leg portion 164 between bends 167 and 169 forms the reveal of the head jamb 22.

An L-shaped beam member 170 having first and second leg portions 172 and 174 joined at a right angle bend 176 is disposed within the opening of channel member 160, with bend 176 being snugly nested in bend 165. Leg portions 172 and 174 may be welded, or otherwise secured, to bight and leg portions 166 and 162, respectively, of channel member 160. The wall return 168 is snugly butted against the outer wall 14, and a filler piece 180 is placed under the edge of the wall 14, directly on leg portion 172. A second filler piece 182 is placed on top of filler piece 180, and it is dimensioned to butt tightly against panel 122 of wall 14, and against leg portion 174 of member 170. A channel member 180, called a J-runner, is conventionally provided by the contractor in dry wall construction, which includes first and second leg portions 182 and 184, respectively, and a connecting bight portion 186. Bight portion 186 is placed directly against filler piece 182, and the J-runner 182 is then power nailed in this position. The inner wallboard 130, a wallboard liner filler 132; which extends for the full opening width, and a wallboard shim 194 are then successively inserted and secured between the leg portions 182 and 184 of the J-runner 180, as described relative to the side jamb 18.

A door header 200 may be supported by brackets (not shown) mounted on the top of the side jambs 18 and 20, or other conventional supports, such as strut angles from the header 200 to the sill 26, and header brackets from the header 200 to the elevator car guide rails, may be used. The door header 200, as illustrated, may include a metallic channel member, such as a channel formed of 0.120 inch thick steel, having first and second parallel leg portions 202 and 204, respectively, and an integral connecting bight portion 206. Channel 200 is mounted with its leg portions depending, and the first leg portion 202 may be bent at 208 and 210 to provide an upstanding flange 212 for receiving a plastic door roller track 214. Door panel 30 includes a hanger 216 having door rollers 218 mounted thereon, which ride on the door track 214.

FIG. 4 is a view similar to that of FIG. 3, except illustrating that a transom 36 may be disposed above the door panels 30 and 32. The head jamb 22 is the same in both embodiments. Like functions in FIGS. 3 and 4 are indicated with like reference numerals, and like functions provided by modified structures in the FIG. 4 embodiment are given like reference numerals with the addition of a prime mark. Transom 36 extends behind the side jambs 18 and 20, and behind the head jamb 22, and is firmly secured thereto. Transom 36 is illustrated as being the flush type, having the same fire rated steel-ribbed construction as the door panel 30'. Door panel 30' is thicker than the door panel 30 of the FIG. 3 embodiment, in order to align the hallway side surfaces of the transom 36 and door panel 30' in the same plane, while mounting the door panel 30' from the back side of the transom 36. In this embodiment, the door header 200 is fastened to the transom 36, and also to the sill and elevator car guide rails via strut angles and header brackets (not shown).

In summary, there has been disclosed a new and improved fire resistant elevator hatchway door entrance suitable for openings in dry wall construction, as well as masonry construction, up to and including 10 feet in height. The new and improved entrance has achieved a 1½ hour fire rating without unduly complicating the structure, or adding significantly to the manufacturing cost. All of the elements of the side jambs may be constructed of 0.090 inch thick steel, with the protection for the dry wall interface being provided essentially by two oppositely facing channel members dimensioned and joined together to cooperatively form a box beam member to which the J-strut is attached, and to also cooperatively form a pocket for receiving the finish wall. The pocket enables the finish wall to extend past the J-strut, with the pocket and box frame structure both providing thermal shielding for the dry wall interface, as well as the necessary strength and rigidity for preventing the side jambs from bowing inwardly away from the dry wall during the fire and hose tests of the fire rating procedure.

I claim as my invention:

1. A fire resistant elevator hatchway door entrance suitable for openings in dry wall construction up to and including 10 feet in height, including a head jamb, first and second side jambs, and at least one slidably mounted door panel having leading and trailing edges, the improvement, comprising:

each of said side jambs including first and second upstanding, oppositely facing channel members, each having first and second leg portions which extend toward the other channel member, and bight portions which are in spaced, parallel relation, said bight portions joining their respective first and second leg portions with first and second right angle bends, the bight portion of said second channel member having a width dimension exceeding that of the first channel member, said first and second leg portions of the first channel member each being bent towards the other leg portion with right angle bends to form first and second aligned flanges, said first channel member being disposed within the opening defined by the first and second leg portions of the second channel member, means joining the first and second channel members with the first leg portion of the second channel member in contact with the entire first leg portion of the first channel member, the right angle bend in the first leg portion of the first channel member nested with the first right angle bend of the second channel member, and with the first and second flanges of the first channel member in contact with the bight portion of the second channel member, to cooperatively define a structural box beam, and with the second leg portion spaced to define a pocket for receiving the wall which defines the opening, said second leg portion of the second channel member including first and second integral flanges, with the first flange being parallel with the second leg portion, and with the second flange being perpendicular to and joining the first flange and associated second leg portion, and a plurality of spaced, U-shaped jamb brackets, each having first and second leg portions and a connecting bight portion, with the first leg portion of each jamb bracket being fixed to the second leg portion of the first channel member, and with its second leg portion being fixed to the first flange of the second channel member, wherein the bight and second leg portions of the second channel member define the jamb depth and reveal, respectively, of the associated side jamb, the second flange functions as a wall return for the reveal, and the bight of the first channel member is adapted to receive and shield an associated J-strut which interfaces the entrance and adjacent dry wall construction.

2. The entrance of claim 1 including a U-shaped member having a leg portion fixed to the trailing edge of the door panel, and wherein the first leg portion of the second channel member extends past the bight of the first channel member, with said extension of the first leg portion extending into the opening defined by said U-shaped member when the door panel is in the entrance closing position, to cooperatively define a flame shield.

3. The entrance of claim 1 including a plurality of reinforcing bracket members fixed in spaced relation within the opening defined by the first and second leg portions and flanges of the first channel member, with each bracket member having first and second leg portions and connecting bight portions, and wherein the first and second leg portions extend snugly along two opposite internal sides of the opening, including the side defined by flanges of the first channel member.

4. The entrance of claim 3 wherein a bracket member is fixed to each end of the side jamb, with openings therein for receiving bolts for anchoring the lower end and for attaching the upper end to the head jamb.

5. The entrance of claim 3 wherein the plurality of bracket members having openings therein for allowing heat to rise and escape from the structural box beam formed by the first and second assembled channel members.

6. The entrance of claim 1 including a transom disposed above at least one door panel, with the side and top edges of the transom extending behind the side jambs and behind the head jamb for a predetermined minimum dimension.

* * * * *